US007893606B2

(12) United States Patent
Lin

(10) Patent No.: US 7,893,606 B2
(45) Date of Patent: Feb. 22, 2011

(54) CONDUCTIVE COMPOSITION AND APPLICATIONS THEREOF

(75) Inventor: Yu-Kai Lin, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 49 days.

(21) Appl. No.: 12/555,398

(22) Filed: Sep. 8, 2009

(65) Prior Publication Data

US 2010/0003884 A1 Jan. 7, 2010

Related U.S. Application Data

(62) Division of application No. 11/674,687, filed on Feb. 14, 2007, now Pat. No. 7,605,528.

(30) Foreign Application Priority Data

Aug. 9, 2006 (TW) ..... 95129253 A

(51) Int. Cl.
*H01J 1/62* (2006.01)

(52) U.S. Cl. ..... 313/491; 445/23

(58) Field of Classification Search ..... 313/491, 313/493, 634; 445/23–25
See application file for complete search history.

(56) References Cited

U.S. PATENT DOCUMENTS

| | | | |
|---|---|---|---|
| 5,479,069 | A | 12/1995 | Winsor |
| 6,885,151 | B2 | 4/2005 | Kim et al. |
| 2005/0130547 | A1 | 6/2005 | Oida et al. |

FOREIGN PATENT DOCUMENTS

| | | |
|---|---|---|
| CN | 1779570 | 5/2006 |

*Primary Examiner*—Joseph L Williams
(74) *Attorney, Agent, or Firm*—Thomas, Kayden, Horstemeyer & Risley, LLP

(57) ABSTRACT

A conductive composition and applications thereof are provided. The conductive composition comprises a mixture consisting of a metal powder and a glass powder. The diameter of the metal powder ranges from about 1 μm to about 3 μm. The diameter of glass powder ranges from about 0.5 μm to about 1 μm. The weight percentage of the metal powder to the mixture is from about 60% to about 98%. The conductive composition could be used to manufacture the electrodes of a flat lamp.

12 Claims, 3 Drawing Sheets

CONDUCTIVE COMPOSITION AND APPLICATIONS THEREOF

RELATED APPLICATIONS

The present application is a divisional of U.S. application Ser. No. 11/674,687, filed on Feb. 14, 2007, which was based on, and claims priority to, Taiwan Patent Application Serial Number 95129253, filed on Aug. 9, 2006, the disclosure of which is hereby incorporated by reference herein in its entirety.

BACKGROUND

1. Field of Invention

The present invention relates to a flat lamp. More particularly, the present invention relates to a conductive composition used in a flat lamp.

2. Description of Related Art

Flat lamp featured by its luminescence efficiency, uniformity and large-area luminescence is widely employed in backlight module of liquid crystal display or other devices. Flat lamp comprises an upper substrate and a lower substrate that cooperatively form a panel-like structure. Each of the outer surfaces of the upper substrate and the lower substrate has an electrode layer disposed thereon. Each of the inner surfaces of the two substrates has a fluorescence layer disposed thereon. The upper substrate and the inner substrate are held together with a space therebetween. When a voltage is applied to the electrode layers, the gas within the space will be excited and thereby emitting an UV light. The fluorescence material in the fluorescence layer would absorb the UV light and convert the same into a visible light with a specific wavelength range. As such, the flat lamp outputting the visible light can be used as a flat light source.

The mixture for forming the electrode layer of the flat lamp is composed of a metal powder, a glass powder and an organic solvent. The glass powder functions as a binder for binding the metal powder with the substrate. Conventionally, the sizes and amounts of the glass powder and the metal powder contained in the electrode layer are about the same. Therefore, a portion of the glass powder may exist at the surface of the electrode layer. Generally, a high temperature process is performed after the electrode layer is formed on the glass substrate, so that a fluorescence layer is formed on the other side of the glass substrate. During the high temperature process, the glass substrate is disposed on a supporting carrier (supporter) with the electrode layer contacting the supporter. In this case, the glass material adjacent to the surface of the electrode layer would be softened and thus binds with the supporter thereunder. Once the electrode layer and the supporter are bound together, it is very difficult to separate the glass substrate from the supporter after the glass substrate, the electrode layer and the fluorescence layer are cooled down. As such, the glass substrate and the supporter would often crack during the separating step. To avoid the cracking issue mentioned above, conventional approach for manufacturing a flat lamp includes the steps as follows. First, a fluorescence layer is formed on the substrate, and the substrate having the fluorescence layer formed thereon is shaped into a corrugated structure. Afterward, two substrates are assembled together. In this case, since the substrate is corrugated in shape, the electrode layer can only be formed by means of soaking or spraying. Then, a baking process is performed to complete the processes for manufacturing the substrate of a flat lamp. However, the electrode layer thus obtained usually has a thickness of about 200 μm to 250 μm, which would increase the production cost. In addition, the electrode layer thus obtained usually has the drawback of uneven thickness, which would jeopardize the product quality. Therefore, a novel method for manufacturing a flat lamp is necessary to be provided to address problems mentioned above.

SUMMARY

The present invention provides a conductive composition of a flat lamp to avoid conventional problem of low yield rate caused by easily broken glass substrate. Furthermore, not only can a thin film electrode layer with uniform thickness is obtained, but the manufacturing process is also simplified and thereby further decreases the manufacturing cost.

In accordance with the foregoing and other aspects of the present invention, a conductive composition for a flat lamp is provided herein. The conductive composition is made of a metal powder, a glass powder and an organic solvent. The amount of the metal powder and the glass powder suspended in the organic solvent is larger than about 60 weight percent of the suspension. The diameter of the metal powder ranges from about 1 μm to about 3 μm. The diameter of the glass powder ranges from about 0.5 μm to about 1 μm. The weight percentage of the metal powder in the composition is from about 60% to about 98%.

In accordance with the foregoing and other aspects of the present invention, a method for manufacturing the substrate of the flat lamp is provided. In one embodiment, the method comprises the steps as follows. A printing process is performed to form a conductive coating layer on the first surface of the substrate. The conductive coating layer is sintered to form a thin film electrode on the substrate. The thickness of the thin film electrode ranges from about 5 μm-200 μm, but the preferred thickness of the thin film electrode ranges from about 10 μm-50 μm and the best thickness ranges from about 10 μm-30 μm.

Also, a fluorescence layer is formed on the second surface of the substrate. The glass substrate, the thin film electrode, and the fluorescence layer are then shaped into a corrugated structure for use as a substrate of the flat lamp. In another embodiment of the invention, the glass substrate and the thin film electrode can be shaped before forming the fluorescence layer.

A flat lamp can be obtained by assembling two substrates prepared as described above with the two fluorescence layers facing each other in such a way that a discharging space is formed between the two substrates.

The present invention not only solves the conventional cracking problem, but also results in a thin film electrode layer with a uniform thickness. In addition, the manufacturing process is simplified and the manufacturing cost is lowered. Furthermore, this invention improves both the product quality and the yield rate.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
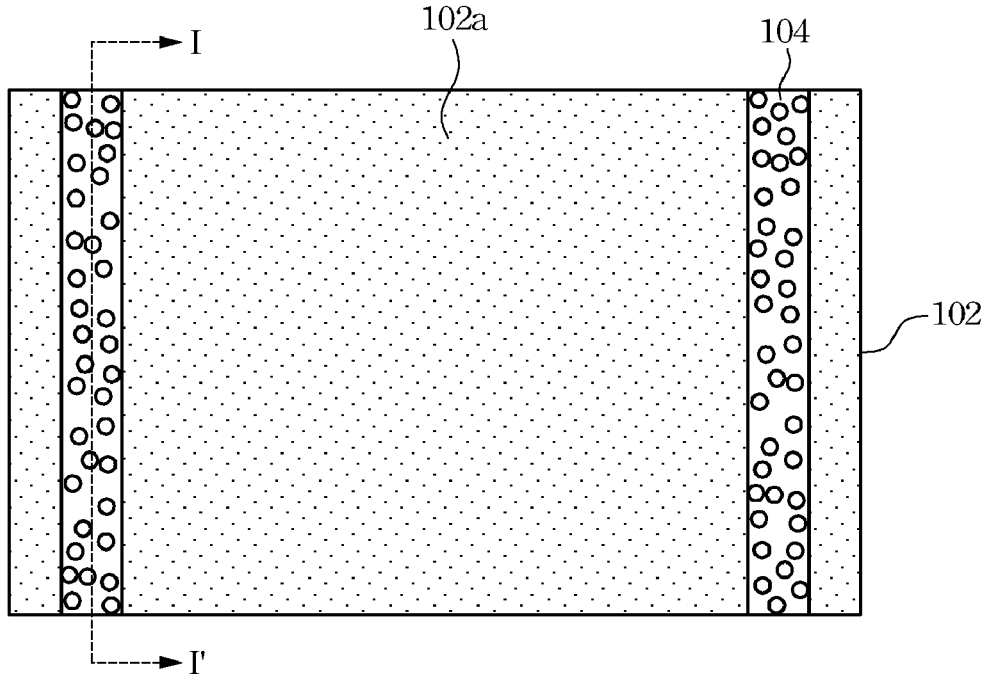
FIG. 1 is a schematic view of a glass substrate with electrode according to an embodiment of the invention.

Please refer to FIG. 1, which is a schematic view of a glass substrate having an electrode formed thereon according to one embodiment of the invention. A glass substrate 102 is cleaned and placed on a supporter (not shown in FIG. 1). A printing process is performed on the substrate to form a conductive coating layer on the first surface 102*a* of the substrate 102. The substrate 102 is baked and the conductive coating layer is sintered to form a thin film electrode 104 on the substrate 102. The thickness of the thin film electrode 104 is about 5 μm-200 μm; the preferred thickness of the thin film electrode 104 is about 10 μm-50 μm; and the more preferred thickness is about 10 μm-30 μm.

Figure 2:
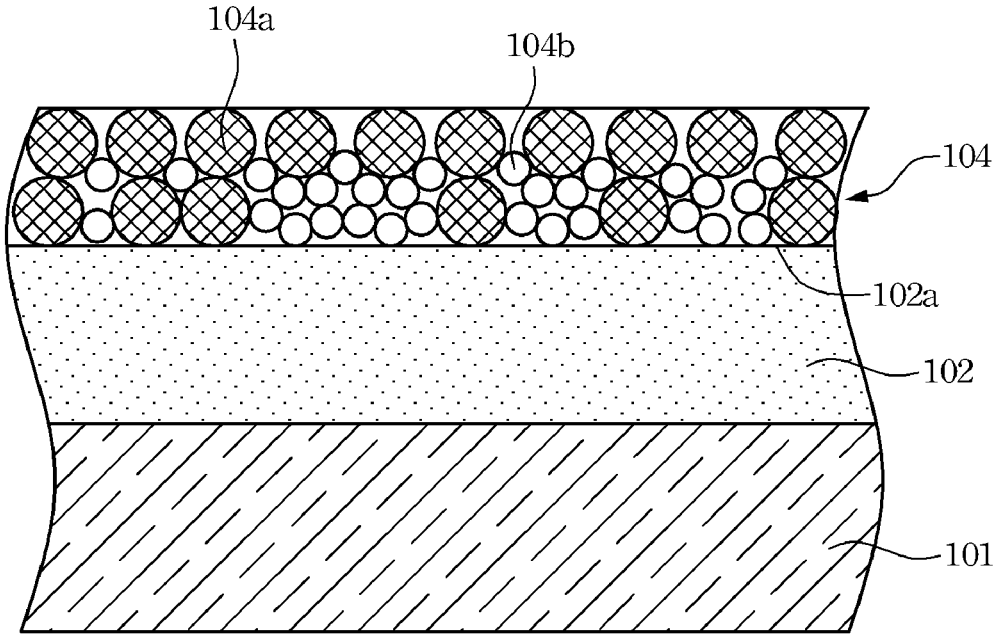
FIGS. 2-4 are cross sectional views of a substrate in a flat lamp according to an embodiment of the invention.

Please refer to FIG. 2, which is a cross sectional view along line I-I' shown in FIG. 1. The substrate 102 is preferably placed on the supporter 101. The thin film electrode 104 is preferably formed on the first surface 102*a* of the substrate 102.

The thin film electrode 104 is made of a conductive composition composed of a metal powder 104*a*, a glass powder 104*b* and an organic solvent. The amount of the metal powder 104*a* and the glass powder 104*b* suspended in the organic solvent ranges from about 60 weight percent of the suspension. The diameter of the metal powder 104*a* ranges from about 1 μm to about 3 μm. The diameter of the glass powder 104*b* ranges from about 0.5 μm to about 1 μm. The weight percentage of the metal powder 104*a* in the mixture of the metal powder 104*a* and glass powder 104*b* is from about 60% to about 98%. The material of the metal powder can be silver, cooper, platinum, tin or any combination thereof.

Figure 3:
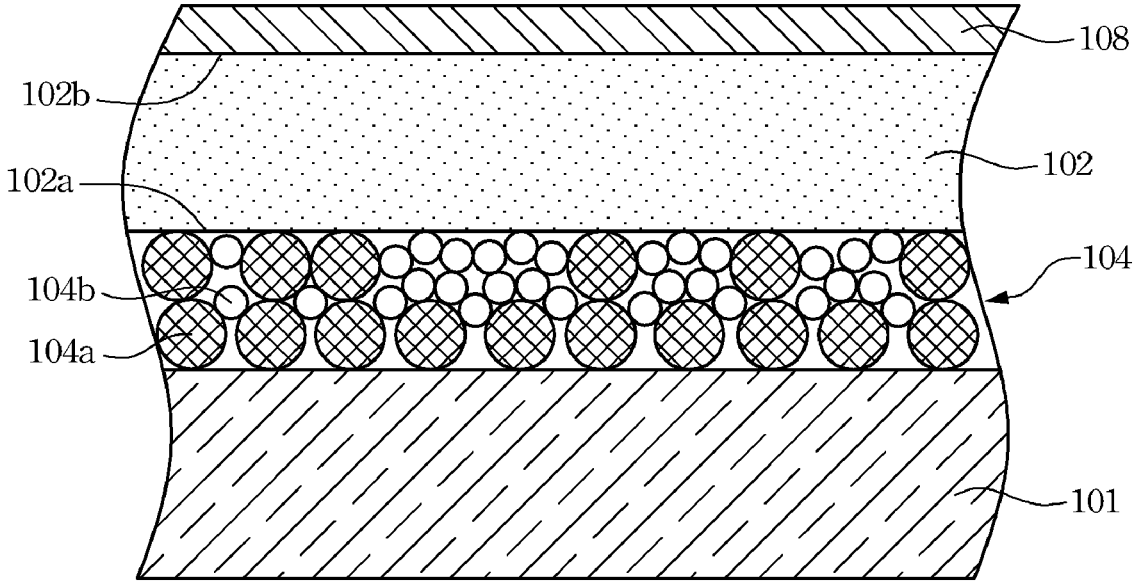

As shown in FIG. 3, after cooling down the glass substrate 102 and the thin film electrode 104, the thin film electrode 104 on the first surface 102*a* of the glass substrate 102 is contacted with the supporter 101, and then a high temperature process is performed to form a fluorescence layer 108 on the second surface 102*b* of the glass substrate 102.

Figure 4:
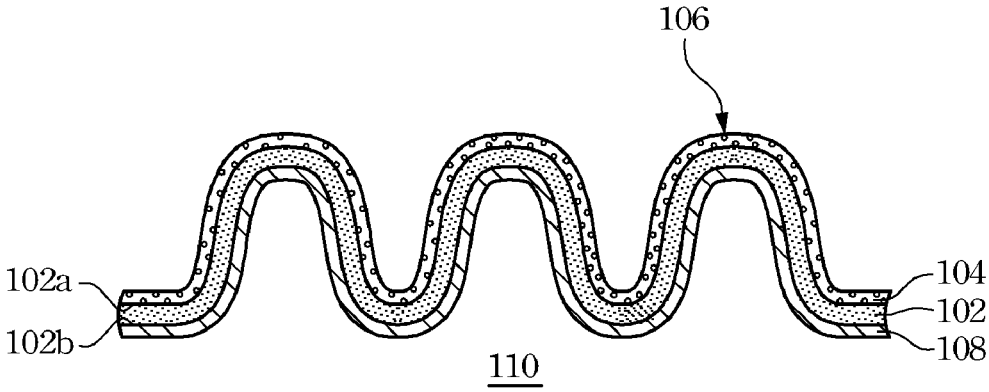

As shown in FIG. 4, the supporter 101 is removed after the fluorescence layer 108 is formed. The glass substrate 102, the thin film electrode 104, and the fluorescence layer 108 are then shaped into a corrugated structure 106 by compress molding or vacuum forming so that a substrate 110 for flat lamps can be obtained. However, the shaping method is not limited to the examples mentioned in this invention. In another embodiment of this invention, the glass substrate 102 and the thin film electrode 104 can be shaped before the fluorescence layer 108 is formed.

Therefore, an embodiment of this invention is to form a conductive coating layer by a printing process. The conductive coating layer is sintered to obtain a thin film electrode with a uniform thickness; then, a fluorescence layer is formed and the glass substrate, thin film electrode and the fluorescence layer are shaped. The shaping process and the fluorescence layer forming process can be done at the same time through one high temperature process. This invention not only obtains a thin film electrode with a uniform thickness but also simplifies the manufacturing process.

As shown in FIG. 2, since the diameter of the metal powder 104*a* is larger than the diameter of the glass powder 104*b*, and the weight percentage of the metal powder 104*a* in the mixture of the metal powder 104*a* and glass powder 104*b* is from about 60% to about 98%, the glass powder 104*b* soften during the sintering process would move downward into the voids between the particles of the metal powder 104*a* to bind the metal powder 104*a* and the glass substrate 102 together. On the other hand, due to the fact that the surface of the thin film electrode 104 contacting with the supporter 101 contains no or little glass powder 104*b*, the thin film electrode 104 and the supporter 101 will not be bound together when performing the high temperature process for forming the fluorescence layer 108. The conventional problem that the glass substrate and the supporter crack easily broken during the separating step can be solved.

Figure 5:
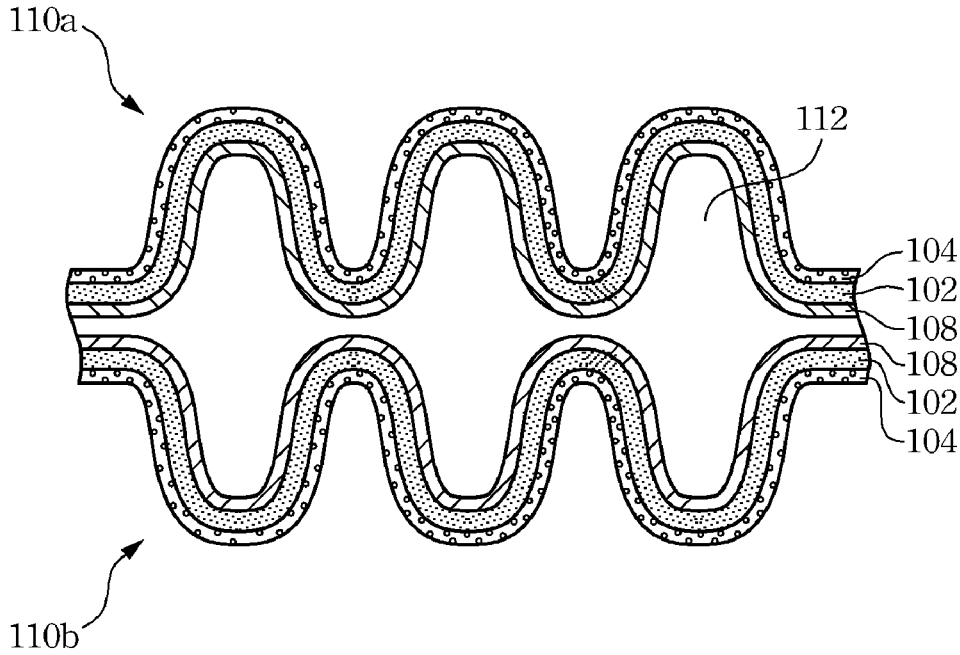
FIGS. 5 and 6 are cross sectional views of two flat lamps according to an embodiment of the invention.

In one embodiment of this invention, a flat lamp can be obtained by assembling two substrates thus obtained together with the two fluorescence layers facing each other in such a way that a discharging space is formed between the two substrates. For example, as shown in FIG. 5, two identical substrates 110*a*, 110*b* are manufactured by the method mentioned above. The two substrates 110*a*, 110*b* are assembled together with a space 112 between and the two fluorescence layers 108 of the two substrates are facing each other.

Figure 6:
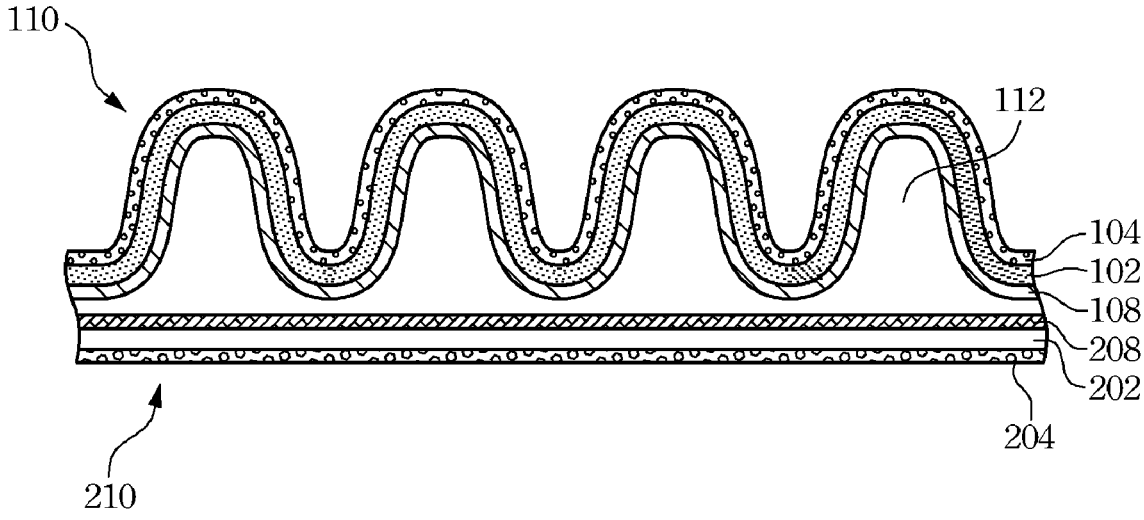

As shown in FIG. 6, it is possible to form a flat lamp having a flat substrate 210 and a corrugated substrate 110. The flat substrate 210 comprises a thin film electrode 204, a glass substrate 202 and a fluorescence layer 208. The flat substrate 210 and the corrugated substrate 110 are assembled together. The fluorescence layer 108 of the substrate 110 and the fluorescence layer 208 of the substrate 210 are facing each other, and the space 112 is formed between the substrate 110 and the flat substrate 210.

The present invention not only solves the conventional cracking problem, but also results in a thin film electrode layer with a uniform thickness. In addition, the manufacturing process is simplified and the manufacturing cost is lowered. Furthermore, this invention improves both the product quality and the yield rate.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A conductive composition used in a flat lamp, comprising a mixture consisting of a metal powder and a glass powder, wherein the diameter of the metal powder ranges from about 1 μm to about 3 μm;

the diameter of the glass powder ranges from about 0.5 μm to about 1 μm; and the weight percentage of the metal powder in the mixture is about 60% to about 98%.

2. The conductive composition of claim 1, further comprising an organic solvent whereby the mixture is suspended therein to form a suspension.

3. The conductive composition of claim 2, wherein the amount of the mixture suspended in the organic solvent is greater than about 60 weight percent of the suspension.

4. The conductive composition of claim 2, wherein the organic solvent is an ester.

5. The conductive composition of claim 1, wherein the material of the metal powder is any one selected from a group consisting of silver, cooper, platinum tin and combinations thereof.

6. A method of manufacturing a substrate of a flat lamp, comprising steps of:

performing a printing process to form a metal powder/glass powder coating layer on a first surface of a glass substrate, wherein the metal powder/glass powder coating layer is formed from the conductive composition of claim 1;

sintering the metal powder/glass powder coating layer to form an electrode on the glass substrate;

forming a fluorescence layer on a second surface of the glass substrate;

shaping the glass substrate and the electrode to form a corrugated structure; and cooling the glass substrate and the electrode.

7. The method of claim 6, wherein the thickness of the electrode ranges from about 5 μm to about 200 μm.

8. The method of claim 6, wherein the thickness of the electrode ranges from about 10 μm to about 50 μm.

9. The method of claim 6, wherein the thickness of the electrode ranges from about 10 μm to about 30 μm.

10. The method of claim 6, further comprising cleaning the substrate before the printing process.

11. The method of claim 6, further comprising backing the glass substrate before the sintering step.

12. The method of claim 6, wherein the shaping step is performed before, at the same time with, or after the sintering step.

* * * * *